US008397414B2

(12) United States Patent
Walters

(10) Patent No.: US 8,397,414 B2
(45) Date of Patent: Mar. 19, 2013

(54) BUTTSTOCK PRE-ADJUSTMENT BLOCK

(76) Inventor: Ian Thomas Walters, Fayetteville, AR (US)

( * ) Notice: Subject to any disclaimer, the term of this patent is extended or adjusted under 35 U.S.C. 154(b) by 91 days.

(21) Appl. No.: 13/066,800

(22) Filed: Apr. 26, 2011

(65) Prior Publication Data

US 2011/0283584 A1 Nov. 24, 2011

Related U.S. Application Data

(60) Provisional application No. 61/395,947, filed on May 20, 2010.

(51) Int. Cl.
*F41C 23/00* (2006.01)

(52) U.S. Cl. ..... 42/73; 42/71.01; 42/75.03; 89/158

(58) Field of Classification Search ..... 42/73, 71.01, 42/75.03; 89/158
See application file for complete search history.

(56) References Cited

U.S. PATENT DOCUMENTS

| | | | | |
|---|---|---|---|---|
| 3,348,328 | A | 10/1967 | Roy | |
| 6,662,485 | B2 | 12/2003 | Kay | |
| 7,213,498 | B1 * | 5/2007 | Davies | 89/198 |
| 7,661,219 | B1 * | 2/2010 | Knight et al. | 42/70.02 |
| 7,757,423 | B1 * | 7/2010 | Swan | 42/127 |
| 7,762,018 | B1 | 7/2010 | Fitzpatrick et al. | |
| 7,891,130 | B2 * | 2/2011 | Griffin | 42/105 |
| 7,891,284 | B1 * | 2/2011 | Barrett | 89/193 |
| 7,930,849 | B2 * | 4/2011 | Abraham et al. | 42/73 |

* cited by examiner

*Primary Examiner* — J. Woodrow Eldred

(57) ABSTRACT

The invention presented here is an add-in part designed for the M4 and similar commercial AR-15 rifle variants or any other weapon using an adjustable multi position receiver extension based on the M4 pattern. Its purpose is to be installed in the longitudinal adjustment slot of the receiver extension tube limiting the buttstock's maximum extension travel to a pre-selected position.

6 Claims, 5 Drawing Sheets

BUTTSTOCK PRE-ADJUSTMENT BLOCK

REFERENCE TO RELATED APPLICATIONS

This application claims an invention which was disclosed in Provisional Application No. 61/395,947 filed May 20, 2010, entitled "Buttstock pre-adjustment block." The benefit under 35 USC §119(e) of the United States provisional application is hereby claimed, and the aforementioned application is hereby incorporated herein by reference.

BACKGROUND OF THE INVENTION

1. Field of the Invention

This application relates to the field of firearms particularly telescoping buttstock mechanisms. More specifically it concerns an improvement to the M4 style and its derivative telescoping buttstocks found on many modern adjustable-for-length firearms.

2. Description of Prior Art

The telescoping buttstock has been fielded by many nations since the advent of modern mechanized warfare moved soldiers into vehicles. Telescoping is defined as an axial longitudinal movement collinear with the barrel and action assembly of the firearm. Early submachine guns utilized a wire type telescoping buttstock in order to decrease the overall length of the weapon when it was not in use. The advantage to such a mechanism is the speed with which the arm can be readied from its collapsed position. Many styles of telescoping buttstock have been created since their introduction but none have been as ubiquitous as the M4 style that was originally created for the M16 family of rifles. Roy in U.S. Pat. No. 3,348,328 took the basic use of a telescoping buttstock and added the extra feature of a number of stopping positions located vertically in the buffer tube or receiver extension. Each position may be locked into by depressing the lever to disengage the locking pin in one position and sliding the stock lengthwise to another position and releasing the lever. This then allows the locking pin to engage vertically in the desired locking detent position. This shall henceforth be referred to as the M4 type adjustable buttstock.

Thus the trigger pull length could be tailored to each shooter that is issued a rifle. This new family of telescoping (or adjustable) buttstocks is today available for and used on rifles, submachine guns, shotguns (as shown by Kay in U.S. Pat. No. 6,662,485) and even belt fed machineguns. It has become the de facto standard due to its end user adaptability. It has a flaw in use, however, in that with the exception of the furthest position a user is unable to immediately ready their weapon from the completely collapsed position. This is due to the fact that there are a number of possibly positions and the user must pass over the undesired detents in order to find that which they prefer. This can be time consuming and in a combat situation, life threatening.

Fitzpatrick et al in U.S. Pat. No. 7,762,018 B1 creates a new assembly of parts to accomplish the length of pull adjustments but also includes the ability to preset the buttstock to a desired position. This however requires an entirely new buttstock to be installed on the gun after previously removing the older, more commonplace and standardized version.

SUMMARY OF THE INVENTION

The present invention allows for any firearm with an attached M4 pattern collapsible buttstock to be able to preset to the users desired length. This includes civilian designated AR-15 and AR-10 variants as well as any other firearm that uses a receiver extension shaped tube on which to mount a buttstock using a longitudinal groove and multiple locking detent positions. The buttstock pre-adjustment block consists of a portion that locks into a locking detent position in the receiver extension and a portion that interferes with the rearward axial movement of the attached collapsible buttstock. The invention allows the firearm operator to preset the desired length by installing a buttstock pre-adjustment block into the receiver extension (buffer tube). By doing so, the user can immediately pull the stock to its desired length without needing to count spaces backwards or forwards. This is particularly useful for any shooter who may be wearing armor or heavy clothing and would need a position located in the middle of the receiver extension.

DETAILED DESCRIPTION OF THE INVENTION

Figure 4:
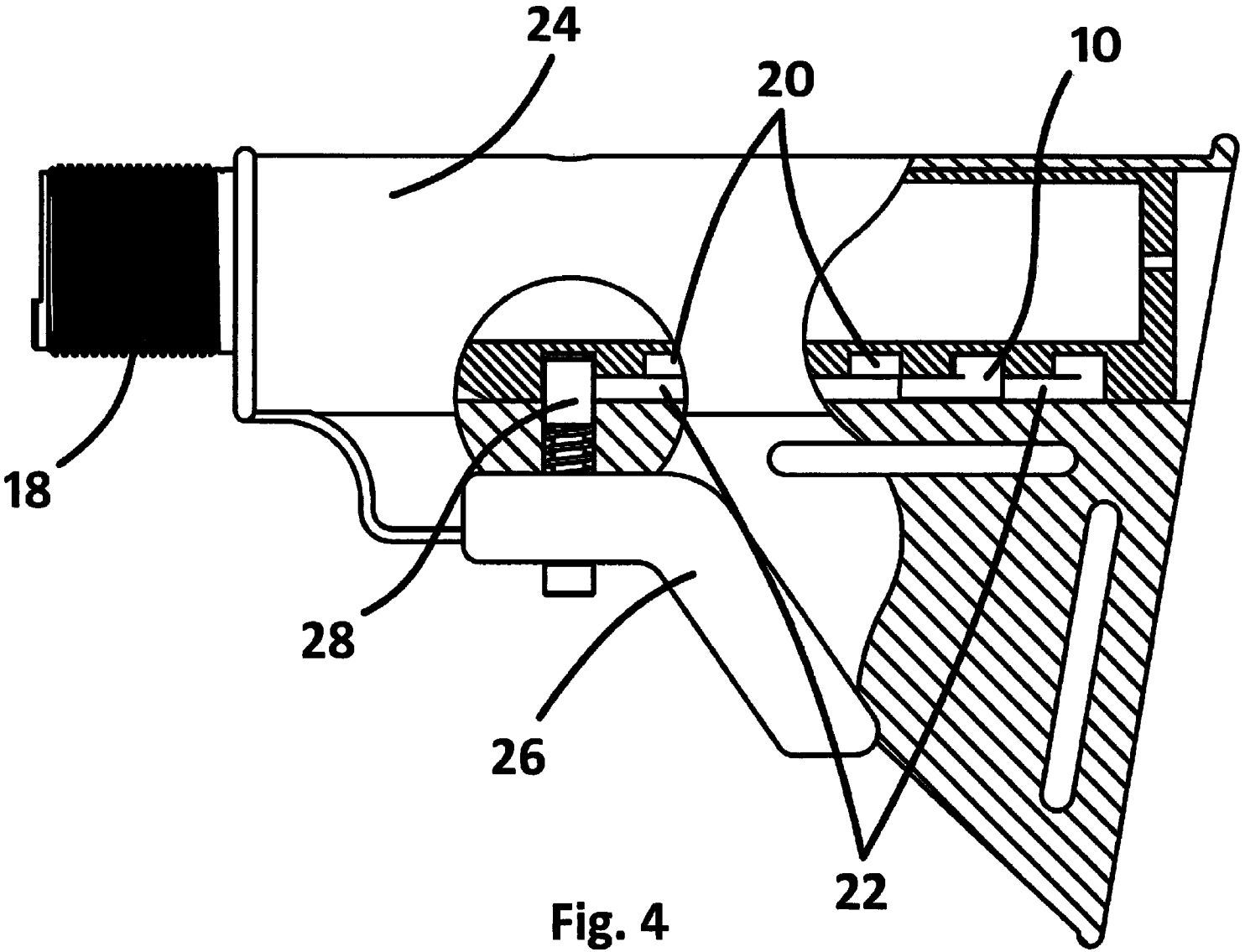
FIG. 4 shows a partial cutaway of an installed buttstock pre-adjustment block in a complete buttstock assembly.
Figure 5:
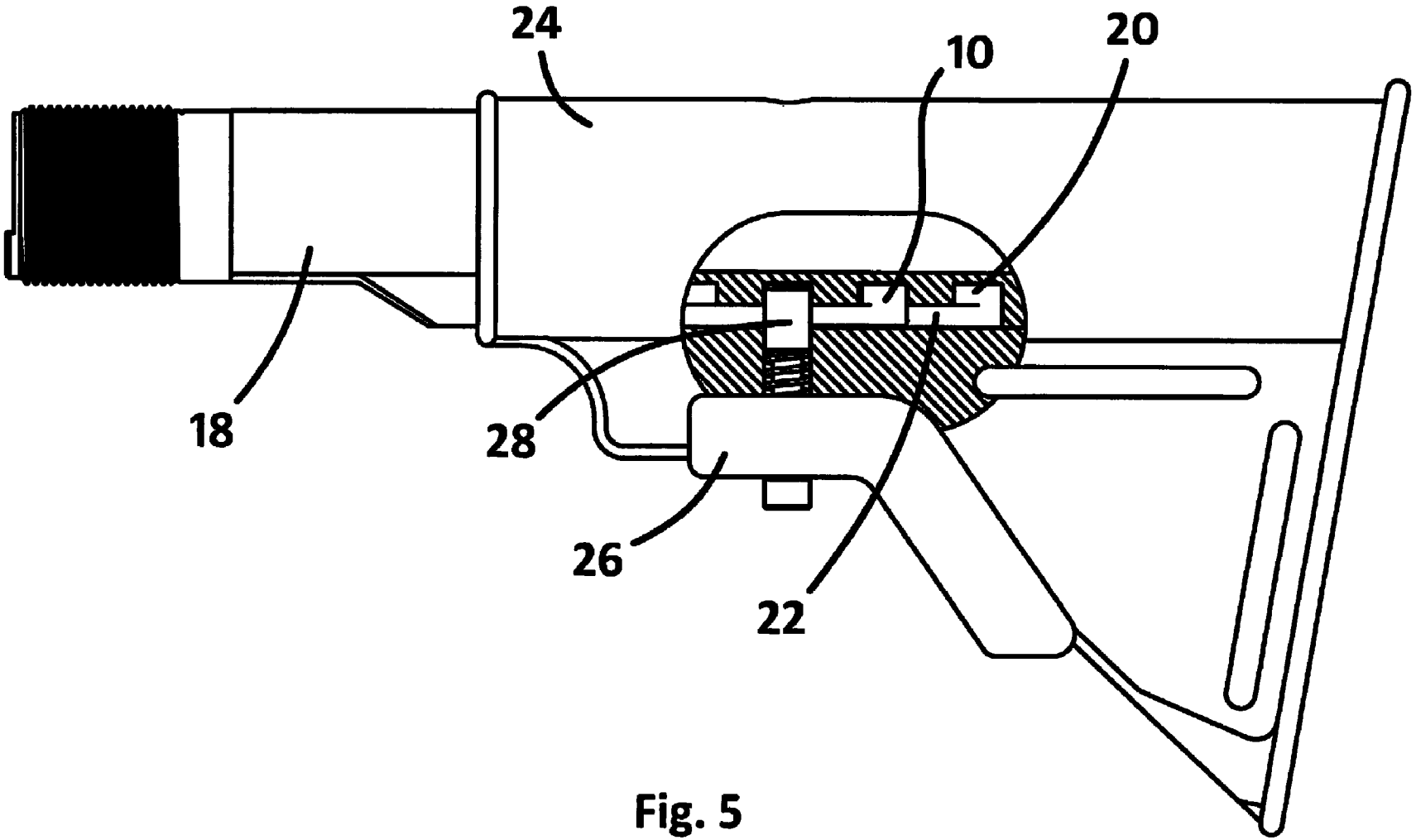
FIG. 5 shows the buttstock extending to the limit set by the pre-adjustment block.

An M4 (AR-15, AR-10, etc.) style telescoping buttstock as shown in FIGS. 4, and 5 has a stock portion 24 as well as a release lever 26 and a locking pin 28. This allows the user of the weapon to actuate the release lever 26 until locking pin 28 retracts from one of the numerous locking detents 20 located in receiver extension 18. The buttstock 24 then is allowed to telescope axially while the locking pin 28 slides lengthwise in the receiver extension's longitudinal groove 22 until the desired position is located. This mechanism allows-for-a multitude of length of pull settings for a single given firearm as well as a more compact overall length for use in transportation scenarios.

The buttstock assembly is often in its most collapsed state when the firearm is not being used; that is actively carried or fired. This could mean that the firearm is simply sitting in a storage rack or has been collapsed for entry and exit of vehicles, buildings, or any other confined area. The transition for a firearm with a collapsible stock in a storage or transportation position to one of readiness can take fractions of a second or much longer, depending on which position the user desires.

For example, if the user's preferred position is where the buttstock is fully extended, the amount of time is minimized as the motion to retract the collapsible buttstock portion 24 until the locking pin 28 collides and stops against the rearmost position of the longitudinal adjustment groove 22 and releasing the adjustment lever 26 allowing the locking pin 28 to drop into the rearmost locking detent 20 can be done in one muscle movement. If however the user's desired position is not the rearmost, the movement becomes much more complicated. Should the user desire any middle position, they then must count locking detent positions 20 back or forth until the most comfortable or necessary point is found. This can take several seconds and in the heat of battle can be difficult.

As shown in FIG. 4, the Buttstock pre-adjustment block 10, when installed into a receiver extension (buffer tube) 18 limits the total travel that a buttstock 24 can travel. More specifically when the pre-adjustment block's upper cylindrical section is inserted into the receiver extension locking detent 20 as shown in FIG. 3 with its lower rectangular portion filling the longitudinal groove 22 in receiver extension 18 it effectively removes the detent position in which it is located as well as any positions behind it by blocking the locking pin 28.

Figure 1:
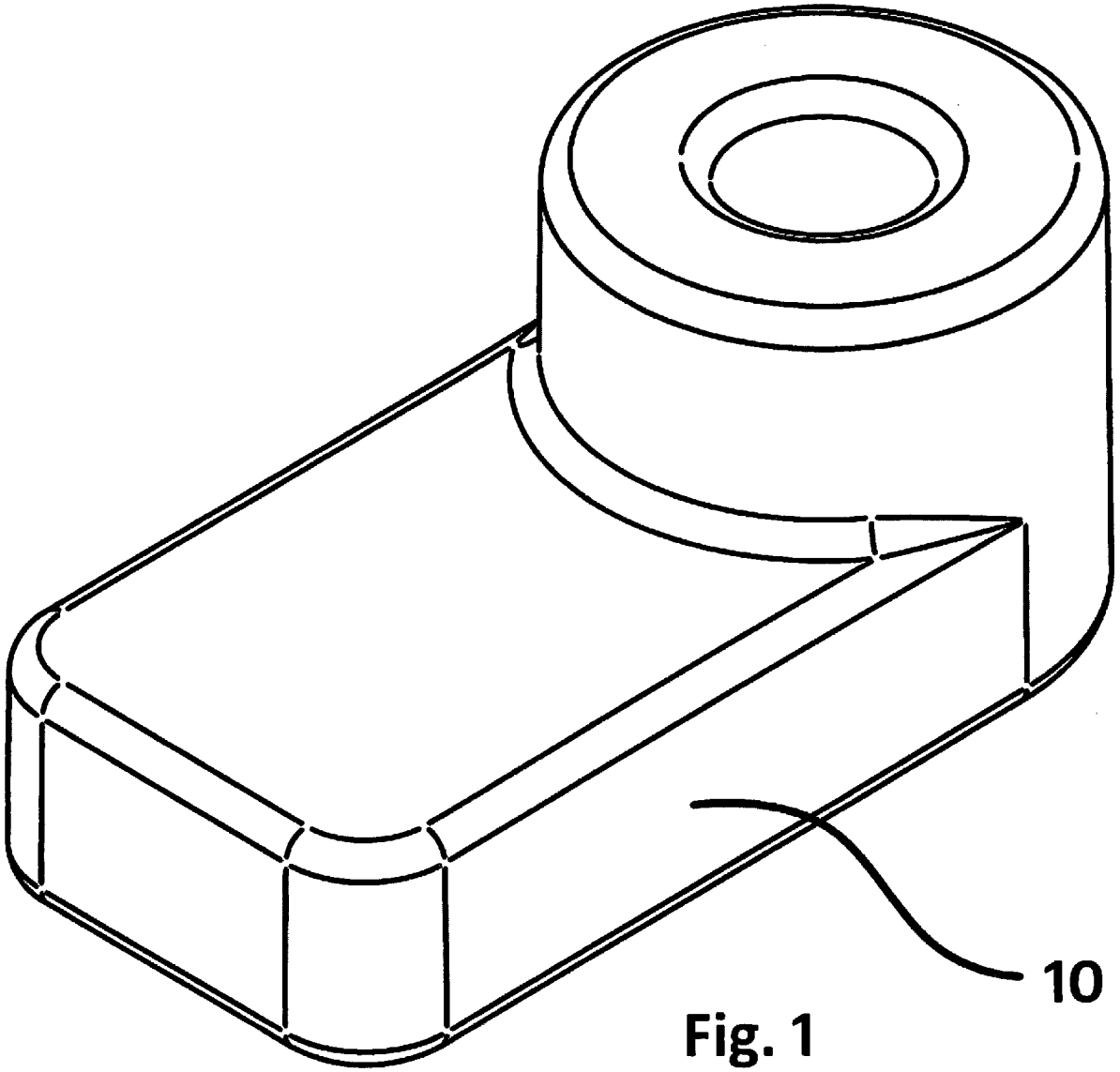
FIG. 1 shows the preferred embodiment of the buttstock pre-adjustment block.
Figure 2:
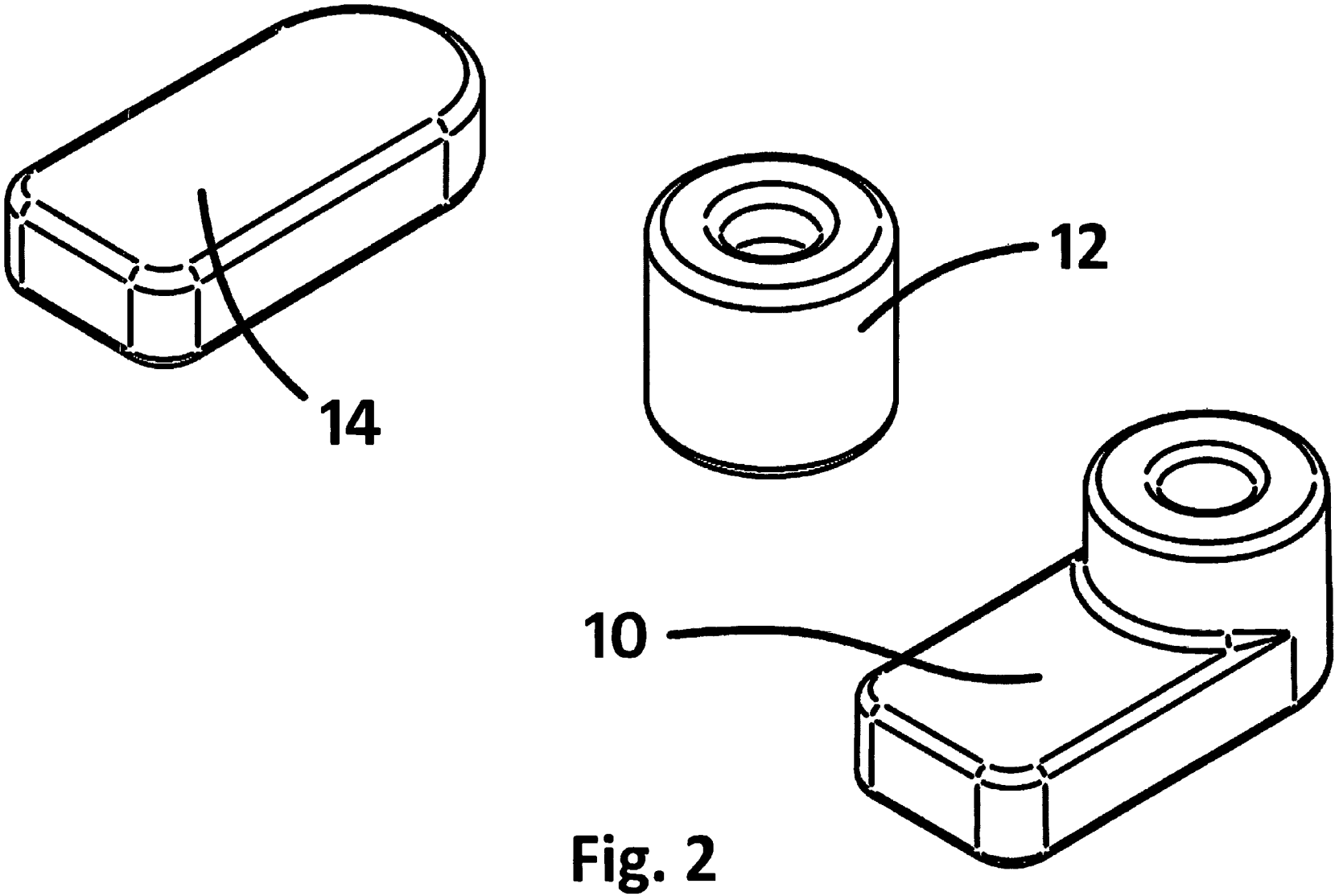
FIG. 2 shows possible alternate embodiments of the buttstock pre-adjustment block.
Figure 3:
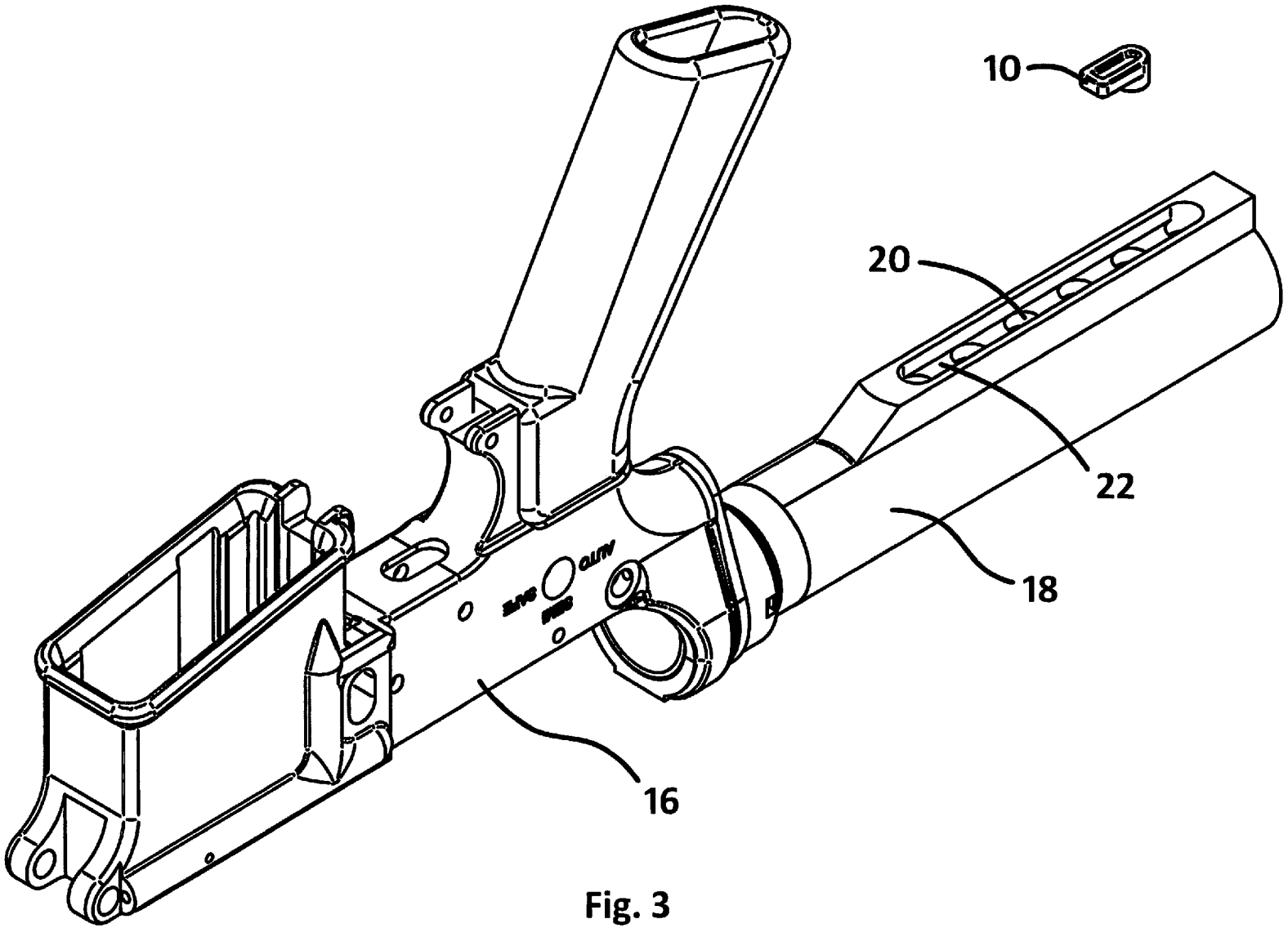
FIG. 3 shows the method of installation.

Thus with a buttstock pre-adjustment block 10 installed before the buttstock assembly 24, as shown in FIG. 3, onto the firearm receiver 16 the most desired position can be selected as the maximum length available. This means that the shooter can immediately adjust the buttstock from its storage position to its readily usable position in a single movement using the least amount of time possible.

The buttstock pre-adjustment block's installation can be done without training or tools. Installation is as follows as demonstrated by FIG. 3.

(1) Remove the current buttstock (not shown) assembly. This is usually accomplished by fully extending the locking pin 28 and sliding the buttstock 24 rearward off the back of the firearm's receiver extension tube 18.

(2) Place block's 10 cylindrical protrusion into the detent position one space behind the preferred locking position (i.e. if you want it set to position five, place the block in position six.) Doing this will prevent the locking pin inside the buttstock assembly from travelling past the desired locking position.

(3) Reinstall buttstock assembly while holding locking pin at full extension until it has passed over the block. The buttstock assembly keeps the pre-adjustment block from falling out.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

I claim:

1. A structural device installed into the longitudinal slot of an M4 type receiver extension prior to the installation of a telescoping carbine buttstock, said M4 type receiver extension comprising:

A cylindrical body predominantly inline with a bore axis of a firearm and,

A lower rectangular portion at a bottom center position of the cylindrical body with a longitudinal slot that contains a plurality of locking detent holes in the underside of it wherein said longitudinal slot is a known depth from the surface of the lower rectangular portion and the locking detent holes are a known depth from the surface of the longitudinal slot designed for the receiving of a telescoping buttstock's positional locking pin wherein the longitudinal slot allows the bin and buttstock to slide fore and aft and the locking detent holes arrest the buttstock via its positional locking pin in a desired position;

Said structural device comprising a body with an upper portion of a cylindrical shape and a lower portion of a rectangular shape wherein the upper portion inserts axially into a locking detent hole and the lower portion occupies space between locking detent holes in the longitudinal slot of an M4 type receiver extension.

2. A structural device installed into the longitudinal slot of an M4 type receiver extension prior to the installation of a telescoping carbine buttstock, said M4 type receiver extension comprising:

A cylindrical body predominantly inline with a bore axis of a firearm and,

A lower rectangular portion at a bottom center position of the cylindrical body with a longitudinal slot that contains a plurality of locking detent holes in the underside of it wherein said longitudinal slot is a known depth from the surface of the lower rectangular portion and the locking detent holes are a known depth from the surface of the longitudinal slot designed for the receiving of a telescoping buttstock's positional locking pin wherein the longitudinal slot allows the bin and buttstock to slide fore and aft and the locking detent holes arrest the buttstock via its positional locking pin in a desired position;

Said structural device comprising a rectangular body that inserts into the longitudinal slot of an M4 type receiver extension and occupies the space between locking detent holes in the longitudinal slot of an M4 type receiver extension.

3. A structural device installed into the longitudinal slot of an M4 type receiver extension prior to the installation of a telescoping carbine buttstock, said M4 type receiver extension comprising:

A cylindrical body predominantly inline with a bore axis of a firearm and,

A lower rectangular portion at a bottom center position of the cylindrical body with a longitudinal slot that contains a plurality of locking detent holes in the underside of it wherein said longitudinal slot is a known depth from the surface of the lower rectangular portion and the locking detent holes are a known depth from the surface of the longitudinal slot designed for the receiving of a telescoping buttstock's positional locking pin wherein the longitudinal slot allows the bin and buttstock to slide fore and aft and the locking detent holes arrest the buttstock via its positional locking pin in a desired position;

Said structural device comprising a cylindrical body wherein the upper half inserts axially into a locking detent hole and the lower half extends into the longitudinal slot of an M4 type receiver extension.

4. Device from claim 1 that when installed prior to a telescoping buttstock prevents the buttstock's positional locking pin from engaging undesired locking detent holes in an M4 type receiver extension during its normal use of extending from a more collapsed position.

5. Device from claim 2 that when installed prior to a telescoping buttstock prevents the buttstock's positional locking pin from engaging undesired locking detent holes in an M4 type receiver extension during its normal use of extending from a more collapsed position.

6. Device from claim 3 that when installed prior to a telescoping buttstock prevents the buttstock's positional locking pin from engaging undesired locking detent holes in an M4 type receiver extension during its normal use of extending from a more collapsed position.

* * * * *